United States Patent [19]

Pogue

[11] 4,282,865

[45] Aug. 11, 1981

[54] APPARATUS FOR EXERCISING A LIMB OF A PATIENT

[76] Inventor: William F. Pogue, P.O. Box 749, DeQueen, Ark. 71832

[21] Appl. No.: 66,223

[22] Filed: Aug. 13, 1979

[51] Int. Cl.[3] ..... A61H 1/02

[52] U.S. Cl. ..... 128/25 R; 128/49

[58] Field of Search ..... 128/25 R, 25 B, 49, 128/51-53, 26, 48, 24.2, 44; 272/93, 96

[56] References Cited

U.S. PATENT DOCUMENTS

| | | | |
|---|---|---|---|
| 847,360 | 3/1907 | Osius | 128/49 |
| 2,267,138 | 12/1941 | Scardamalia | 128/49 |
| 2,273,088 | 2/1942 | Byers | 128/25 R |
| 2,674,242 | 4/1954 | Bierman | 128/25 B |
| 2,912,976 | 11/1959 | Grund | 128/49 |
| 2,929,375 | 3/1960 | Spinks | 128/25 R |
| 3,301,553 | 1/1967 | Brakeman | 128/25 R |
| 3,521,622 | 7/1970 | Collins | 128/25 R |
| 3,580,244 | 5/1971 | Graves | 128/25 B |
| 3,800,785 | 4/1974 | Inada | 128/52 |
| 4,086,921 | 5/1978 | Gonzales et al. | 128/24.2 |

*Primary Examiner*—John D. Yasko

*Attorney, Agent, or Firm*—Burns, Doane, Swecker & Mathis

[57] ABSTRACT

Apparatus for exercising a limb of a user comprises a housing, a movable member on the housing which engages a limb of a user, and a drive mechanism on the housing for reciprocating and/or oscillating the movable member to exercise the user's limb.

18 Claims, 11 Drawing Figures

APPARATUS FOR EXERCISING A LIMB OF A PATIENT

BACKGROUND AND OBJECTS OF THE INVENTION

The present invention relates to therapeutic exercising devices and, more particularly, to a device for mechanically exercising the muscles and joints of a user's body.

Devices have heretofore been proposed for mechanically exercising the muscles or joints of a person who is incapable of self-exercise, as evidenced for example, by the disclosures in U.S. Pat. No. 964,898 issued to Budingen on July 19, 1910, U.S. Pat. No. 2,815,020 issued to Barkschat on Dec. 3, 1957, U.S. Pat. No. 3,301,553 issued to Brakeman on Jan. 31, 1967, and U.S. Pat. No. 3,540,435, issued to Smith on Nov. 17, 1970. Those devices are rather cumbersome and mechanically complicated and may offer only uni-directional exercising of the joints, rather than a more desirable multi-directional exercising. All of the above-noted patents, except that to Smith, are adapted only to exercise the user's legs. The Smith apparatus is able to exercise arms and legs, but is rather unwieldy.

It is, therefore, an object of the present invention to minimize or obviate the problems of the above-discussed type.

It is another object of the present invention to provide an exercising apparatus which is able to exert multi-directional exercising motions on the muscles or joints of a user.

It is a further object of the invention to provide such an exercising apparatus which combines linear and oscillatory exercising motions on a user's limbs.

It is an additional object of the present invention to provide an exercising apparatus which is capable of exercising either the arms or legs of a patient.

It is a further object of the invention to provide an exercising device which is relatively compact and easily adaptable to a bed patient.

BRIEF SUMMARY OF THE INVENTION

These objects are achieved by an apparatus for exercising a limb of a user. The apparatus comprises a housing and a movable member on the housing for engaging a limb of a user. A drive mechanism on the housing simultaneously reciprocates and oscillates the movable member to exercise the user's limb.

THE DRAWING

The objects and advantages of the invention will become apparent from the following detailed description of a preferred embodiment thereof in connection with the accompanying drawings in which like numerals designate like elements, and in which.

DETAILED DESCRIPTION OF A PREFERRED EMBODIMENT OF THE INVENTION

Figure 2:
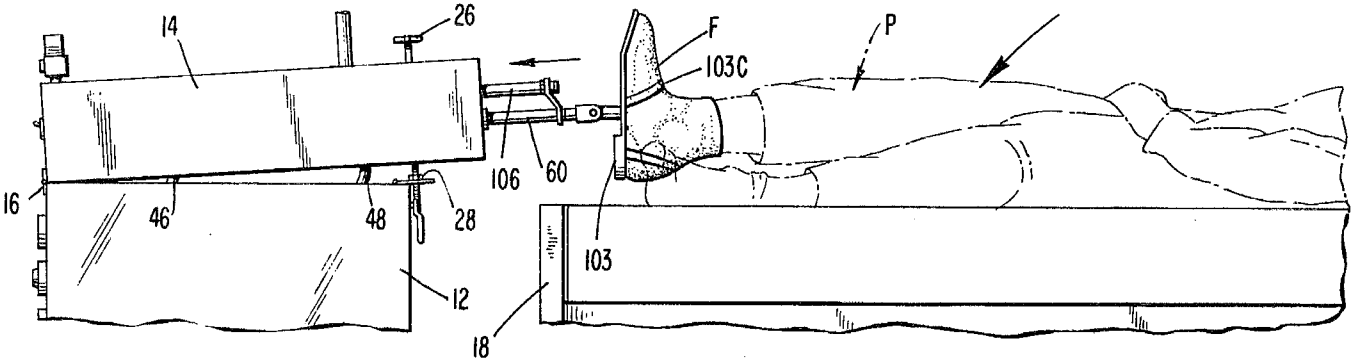
FIG. 2 is a view similar to FIG. 1 wherein the rod is in a retracted mode.
Figure 1:
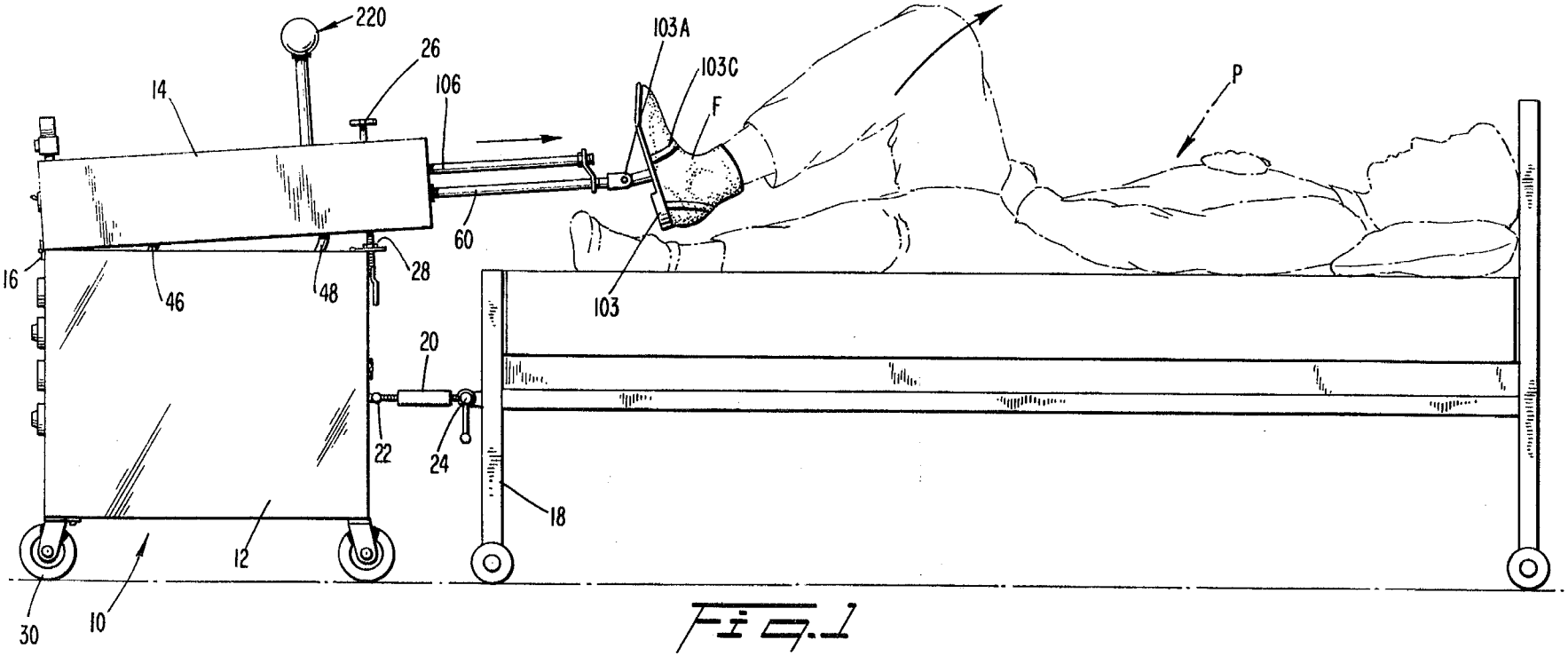
FIG. 1 is a side elevational view of a patient whose leg is exercised by an exercising apparatus according to the present invention, wherein a reciprocating rod of the apparatus is in an extended mode.

An exercising apparatus 10 according to the present invention is depicted in FIG. 1 in a mode whereby a foot F of a patient P is being mechanically exercised. The exercising apparatus includes a lower housing section 12 and an upper housing section 14 pivotally connected to the lower housing section 12 by means of a horizontal hinge 16 at a back side of the housing.

The lower housing section is connected to a bed 18 (FIG. 6) of the patient by means of one or more toggle links 20 which are each pivotally connected at one end 22 to the lower housing section 12 and at the other end 24 to a bracket on the bed 18. The toggle links 20 enable the exercising apparatus to be fixed in position relative to the bed at a variable spacing relative thereto.

The inclination of the upper housing section 14 is adjustable relative to the lower housing section 12 within a range of 20° from horizontal by means of rotary adjusting screws 26 which are freely rotatable in the lower housing section 12 and are threadedly received within a threaded collar 28 (FIG. 3) of the upper housing section. The lower housing section is mounted on wheels 30 so as to be manually portable.

The lower housing 12 defines an inner compartment 32 in which are housed various components of the actuating mechanism of the exercising apparatus. Such components include a reservoir 34 containing hydraulic oil, an electric motor 36 and a hydraulic pump 38 which is operated by an output shaft 40 of the motor 36. A conduit 42 is connected between the reservoir 32 and an inlet of the pump 38 to enable the pump 38 to draw hydraulic fluid from the reservoir 34. A conventional electric reversing valve 44 is mounted atop the pump 38 and is operable to direct hydraulic fluid from the pump alternately to conduits 46, 48. Those conduits 46, 48 conduct hydraulic fluid in a manner controlling the forward and reverse motions, respectively, of a hydraulic ram 50 which is mounted in the upper housing 14. Alternatively, a pneumatic ram could be employed.

The cylinder 52 of the hydraulic ram 50 is rotatably mounted within a pair of front and rear bearings 54, 56 which are secured to a lower wall 58 of the upper housing section 14, to enable the hydraulic ram to rotate about its longitudinal axis. A rod portion 60 of the hydraulic ram 50 projects through an opening 62 in a front wall 64 of the upper housing. The conduit 46 communicates fluidly with a rear end of the ram 50, whereas the conduit 48 communicates with a front end of the ram 50. Actuation of the reversing valve 44 so as to direct pressurized hydraulic fluid to the rear end of the ram 50 causes the rod 60 to extend. Simultaneously, hydraulic fluid is exhausted from the front end of the ram 50 and returns to the reservoir 34 via conduit 48, the reversing valve 44, and a return conduit 66 extending between the reversing valve 44 and the reservoir 34. Reversal of the valve 44, whereby pressurized hydraulic fluid is conducted to a forward end of the ram 50 via the conduit 48, causes the rod 60 to retract. In that case, hydraulic fluid is exhausted from the ram via the conduit 46 and returns to the reservoir 34 through the return line 66.

A load and pressure control valve 68 is provided in the lower housing 12. The valve 68 includes a metering end 70 disposed in the fluid junction defined by: an outlet conduit 72 from the hydraulic pump 38, the conduit 46, and a bypass conduit 74 communicating with the reservoir 34. By selective rotation of the valve 68, the metering end 70 progressively opens or closes communication between the conduits 72 and 74, thereby regulating the amount of fluid returned to the reservoir via the bypass 74. A forward variable speed control valve 76 is provided which selectively restricts or exposes the conduit 46 to vary the forward speed (i.e., to the right in FIG. 3) of the ram 50. A similar valve 78 is disposed in the conduit 48 to regulate the reverse speed. A pressure gauge 80 is provided for measuring pressure in the conduit 46. A similar gauge may be disposed in the conduit 48.

Thus, by actuating the pump motor 36, the rod 60 is reciprocated in linear fashion. By attaching a user's foot F to the rod, it can be therapeutically exercised. The therapeutic action can be augmented in accordance with the present invention because a rotational oscillatory motion can be included. To this end, there is provided an oscillation mechanism for rotating the cylinder of the ram 50, and an oscillation transmitting mechanism for transmitting such oscillatory motion to the rod 60.

The oscillation mechanism comprises an electric motor 90 mounted to the bottom wall 58 of the upper housing section 14. The motor 90 includes a rotationally driven disc 92 (FIG. 4) constituting a crank member to which is pivotably connected one end of a link 94. The other end of the link 94 is pivotably connected to a flange 96 which extends radially outwardly of the rear end of the ram cylinder 52. The link 94 may be selectively connected to any one of a plurality of openings 98, 100, 102 formed in the flange 96. Selection of the particular opening 98, 100, 102 enables the extent of rotary oscillation of the housing 52 to be varied. As the disc 92 of the motor 90 rotates, oscillatory movement is transmitted to the ram cylinder 52 by means of the link 94.

Preferably, if the link 94 is connected to the outermost opening 102, the cylinder will be oscillated by 20°, i.e., plus or minus 10° from opposite sides of a rest position. If the link 94 is connected to the opening 100, the cylinder 52 oscillates within a 40° range, i.e., plus or minus 20°. If the link 94 is connected to the opening 98, a 60° range, i.e., plus or minus 30° is provided. It will be appreciated that additional adjustment positions could be provided.

A foot rest 103 is connected to the outer end of the rod 60. The foot rest 103 is adjustable within a variety of positions by means of a pivotal connection 103A which can be selectively loosened and tightened by a bolt 103B. A user's foot F can be secured in any convenient fashion to the foot rest 103, such as by straps 103C.

The oscillation transmission mechanism 104 comprises a bar 106 telescopingly received within a sleeve 108. The sleeve 108 is affixed to the cylinder 52 of the ram 50 by means of connector members 110. An arm 112 is rotatably connected to an outer end 114 of the bar 106 and is fixedly connected to an outer end 116 of the cylinder rod 60. Accordingly, as the cylinder of the ram 50 is oscillated, such movement is transmitted to the rod 60 through the members 110, 108, 106, and 112 of the oscillation transmission mechanism 104.

Figures 6, 7:
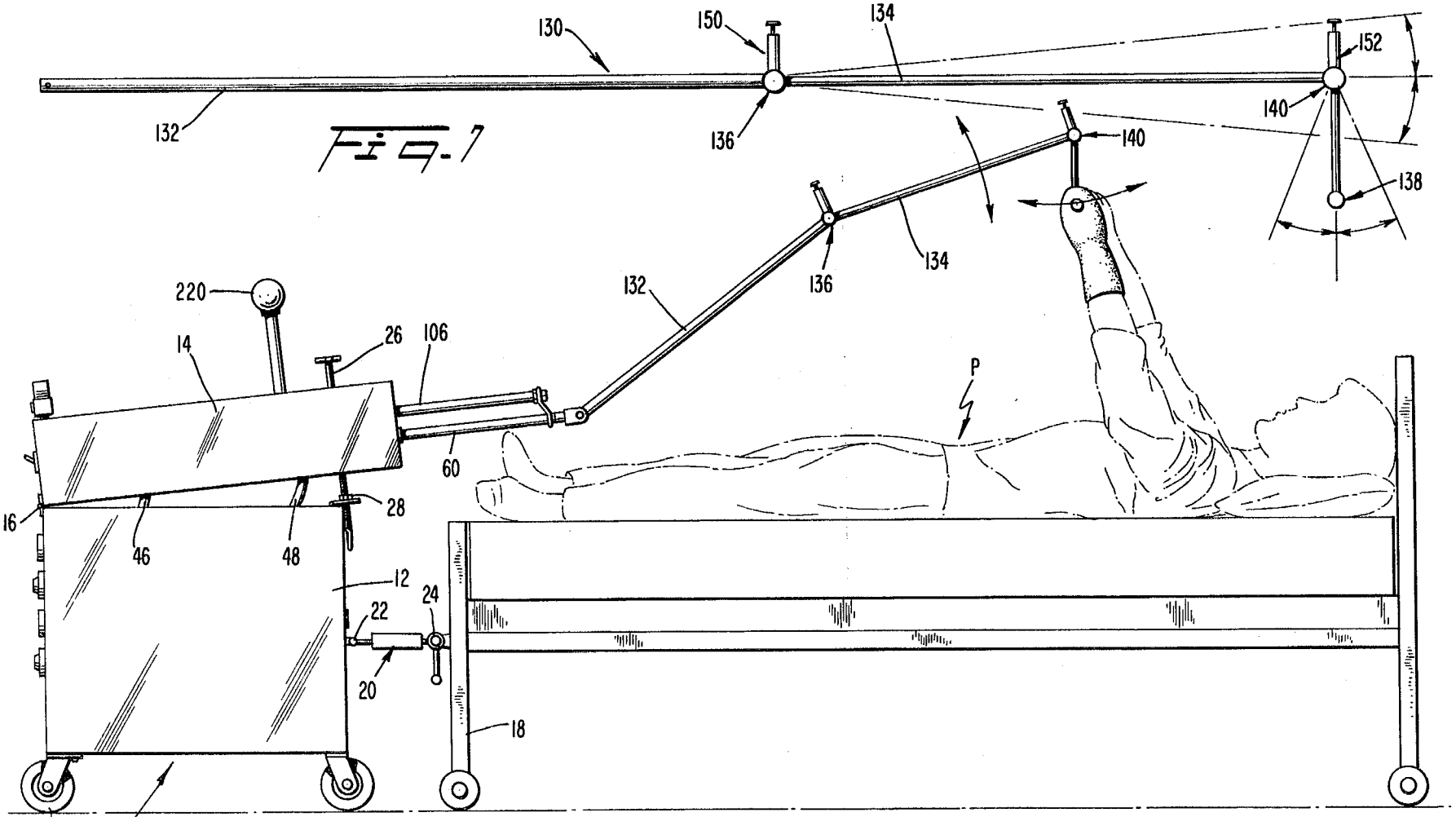
FIG. 6 is a view similar to FIG. 1 wherein the arms of a user are exercised.
FIG. 7 is a side elevational view of a bar assembly for exercising a user's arms.

In lieu of attaching a user's foot to the rod 60, the present invention makes provision for attaching thereto the user's arm. To achieve this, there is provided a separate attachment, viz., an arm exercising bar assembly 130 (FIGS. 6–7). The arm exercising bar assembly 130 comprises first and second bar sections 132, 134 which are joined in end-to-end fashion by a coupling 136 which permits relative pivotal movement between the sections about only a horizontal axis extending perpendicular to the bar axis. That is, the second bar section 134 can pivot upwardly or downwardly relative to the first bar section 132, but cannot roll to either side. In this fashion, all oscillatory motions from the rod 60 are transmitted to the second bar section 134 and ultimately to the user's arm.

Figure 8:
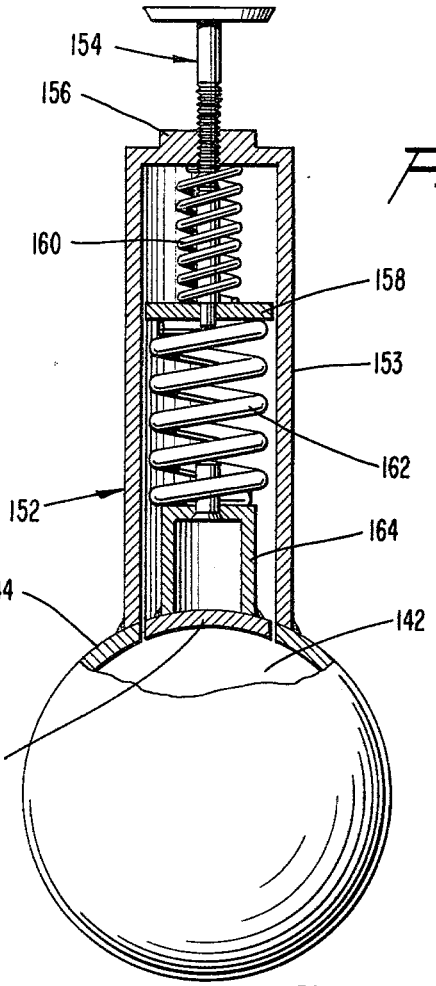
FIG. 8 is a cross-sectional view through a tensioning mechanism for a pivotal connection securing a hand grip to the bar assembly.
Figure 9:
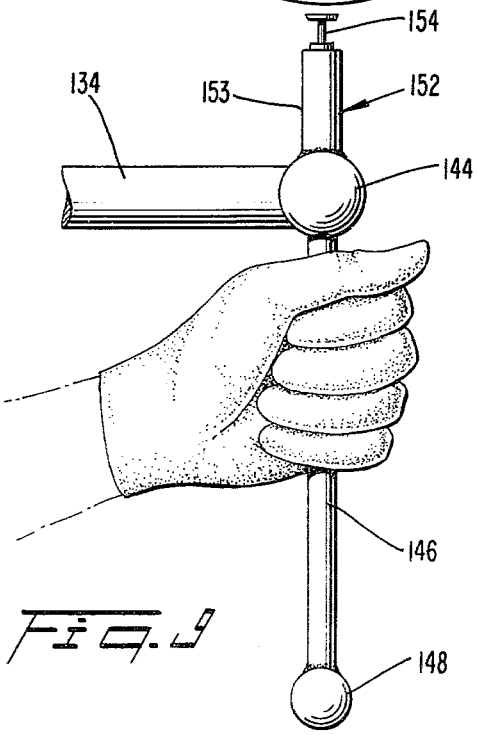
FIG. 9 is a side view of an end of the bar assembly, depicting one manner in which it can be gripped by a user.
Figure 10:
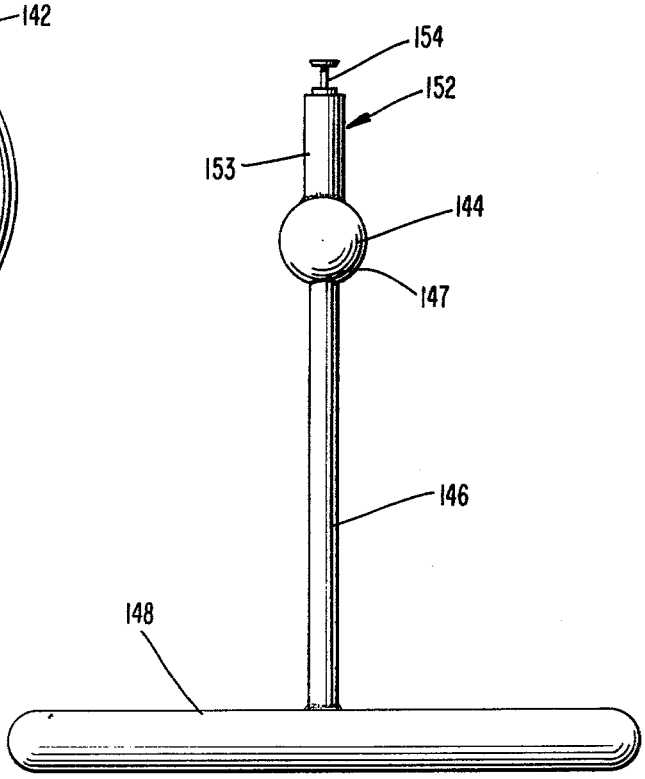
FIG. 10 is an end view of the bar assembly as viewed by the user.

A hand grip 138 is pivotably mounted to an outer end of the second bar section 134 by a coupling 140 similar to the coupling 136 mentioned earlier, to prevent relative side-to-side motion between the second bar section 134 and the hand grip 138. Preferably, the coupling 140 comprises a ball 142 (FIG. 8) mounted within a spherical sleeve 144. A stem 146 (FIG. 9) of the hand grip 138 is secured to the ball 142 and projects through a slot 147 in the sleeve. The slot permits relative pivotal movement between the hand grip 138 and the second bar section 134 about a horizontal axis disposed perpendicular to the second bar section 134, but transmits sideways oscillation to the hand grip 138. Thus, a user's hand which is secured to a lateral part 148 of the hand grip 138 or to the stem 146 thereof (FIG. 9) is both reciprocated and oscillated, thereby exercising the arm, hand, elbow, shoulder, and wrist.

In order to regulate the degree of looseness of the couplings 136, 140, tensioning mechanisms 150, 152 are provided. Each tensioning mechanism includes a casing 153 mounted on the spherical sleeve 144. A threaded screw 154 (FIG. 8) is threadedly secured to the top 156 of the casing and bears against a plate 158 which is movable within the casing. A first coil compression spring 160 is positioned between the plate and the top of the casing, and a second coil compression spring 162 is positioned between the plate 158 and a pressing element 164. The pressing element includes a spherical segment 166 which is adapted to bear against the ball 142 and retard rotation thereof. By lowering the screw 154, the spring 162 is compressed and the segment 166 bears more tightly against the ball 142. By raising the screw, the spring 162 is allowed to expand, thereby diminishing the resistance applied to the ball.

Figure 11:
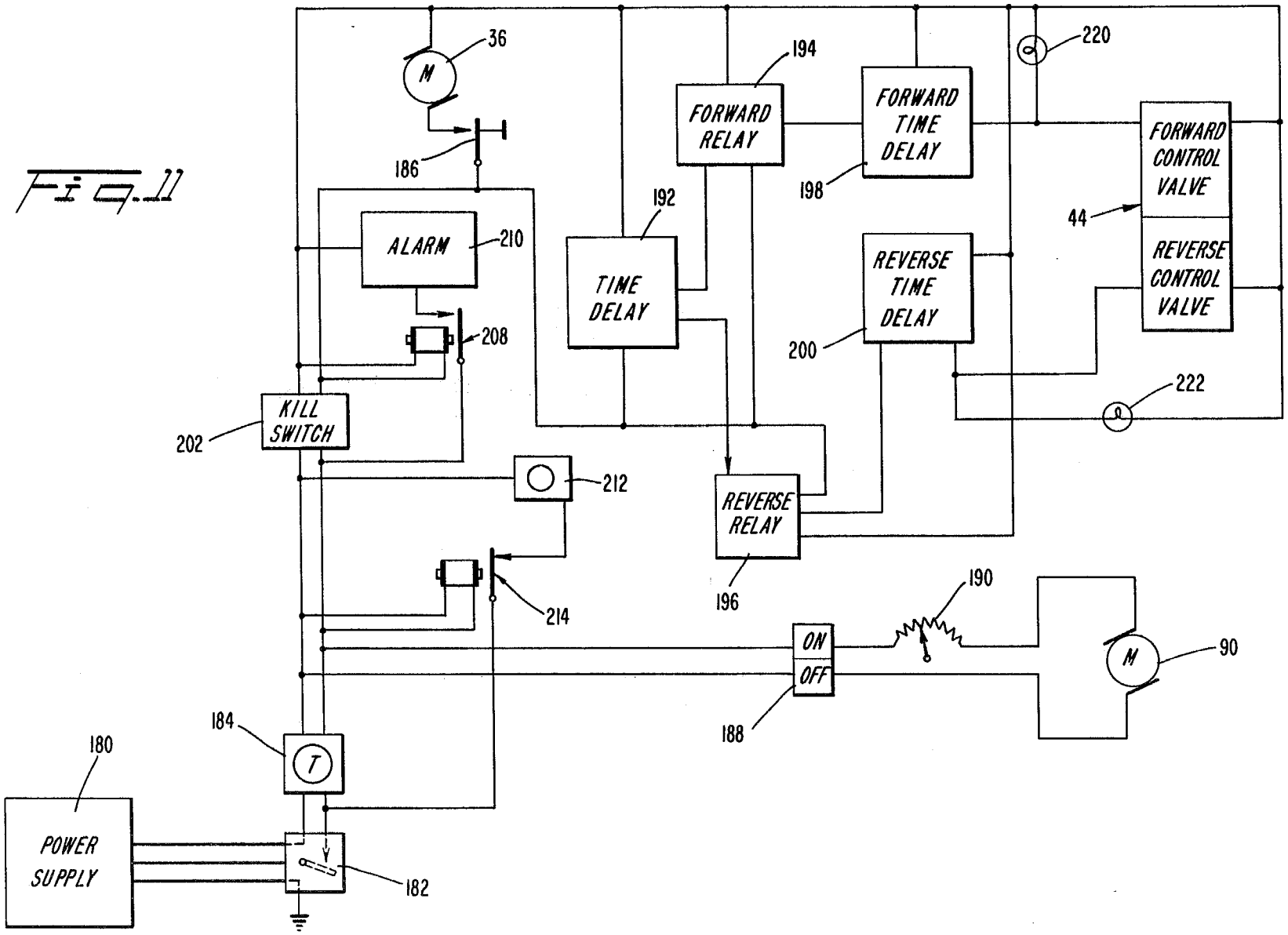
FIG. 11 is a diagrammatic view of a power system for the apparatus.

It will be appreciated that the apparatus may be operated by different control systems. A preferred control system is depicted in FIG. 11. Electrical power is supplied from a main power supply 180 and is fed to an electric control circuit by means of a master switch 182. When the master switch 182 is turned on, the system is activated for a predetermined time period, determined by an adjustable timer 184. A pair of switches 186, 188 are provided for actuating the motors 36, 90, respectively, for reciprocating the fluid ram 50 and oscillating the piston rod 60. Those motors 36, 90 may be operated selectively, or in unison, as desired. The degree of oscillation is controlled by the setting of the connecting link 94 between the disc 92 and the flange 96. The speed of oscillation is controlled by a manually adjustable rheostat 190.

The speed of reciprocation of the rod 60 is controlled by the aforementioned needle valves 76, 68 in the conduit. The length of the stroke is determined by a time relay 192 acting in conjunction with the speed of reciprocation. The time relay is adjustable between 0 and 30 seconds, after which period it functions to reverse the direction of travel of the ram, via forward and reverse relays 194, 196 of the type which are closed when energized. Those relays 194, 196 control the reversing valve 44. In order to provide a rest period at the end of the forward and/or rearward strokes, a forward time delay relay 198 and a reverse time delay relay 200 are provided which are each adjustable from 0 to 10 seconds.

Figures 3, 4:
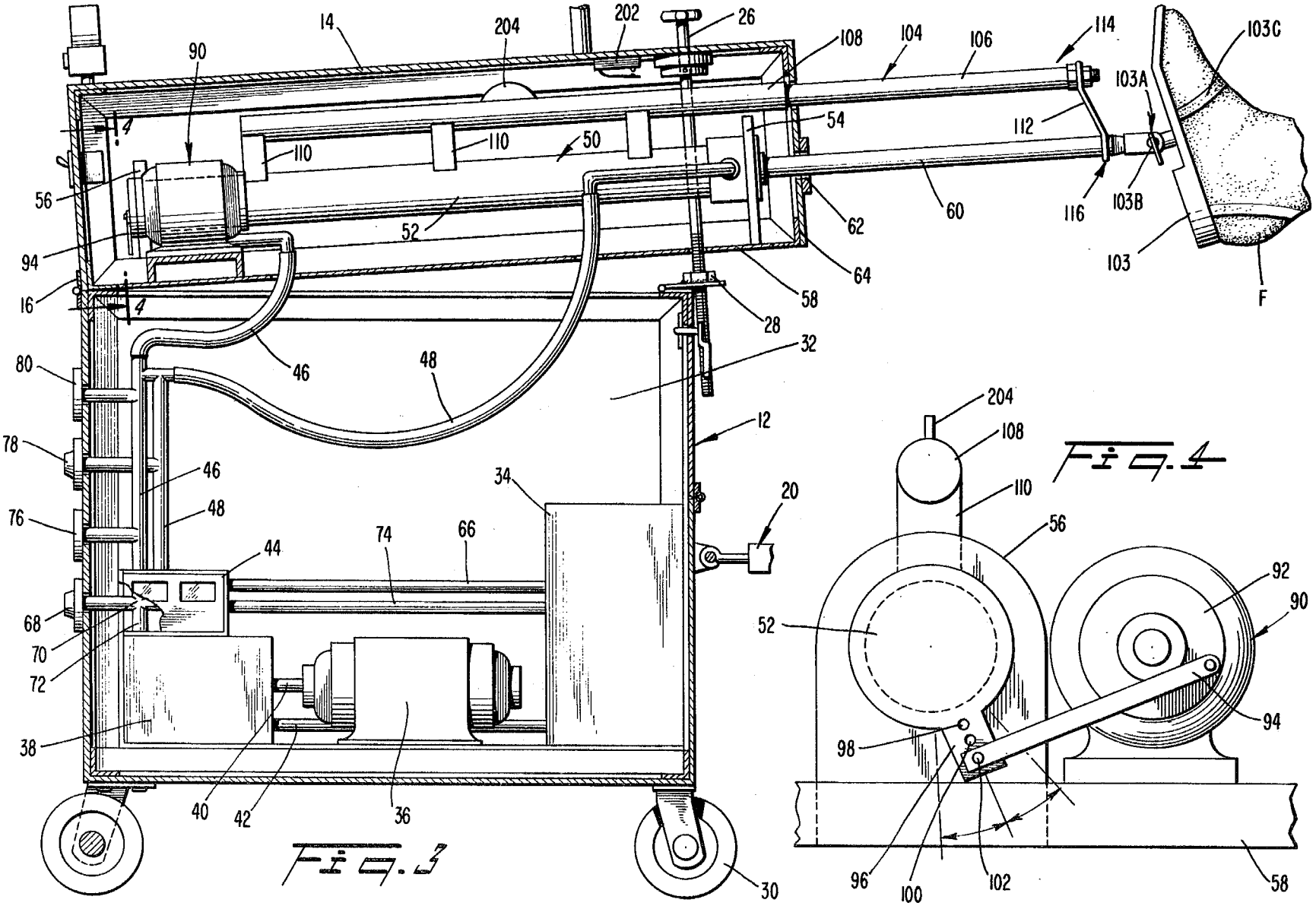
FIG. 3 is a side elevational, cross-sectional view of the exercising apparatus.
FIG. 4 is a rear view of a reciprocating fluid ram of the exercising apparatus, depicting the manner of connecting an oscillatory motor thereto.

A kill switch 202 is provided for deactivating the system in the event that the stroke of the piston rod 60 exceeds the preset stroke length. The kill switch 202 is adjustable and is positioned to be actuated by a projection 204 on the bar 106 of the oscillation transmitting mechanism 104 (FIGS. 3-4). The projection 204 projects through a slot in the sleeve 108. If the kill switch is actuated, it deactivates the pump motor 36 and activates an emergency alarm relay 208, the latter actuating an emergency alarm 210. At the end of the treatment, a signal light 212 is lit by means of a relay 214.

Figure 5:
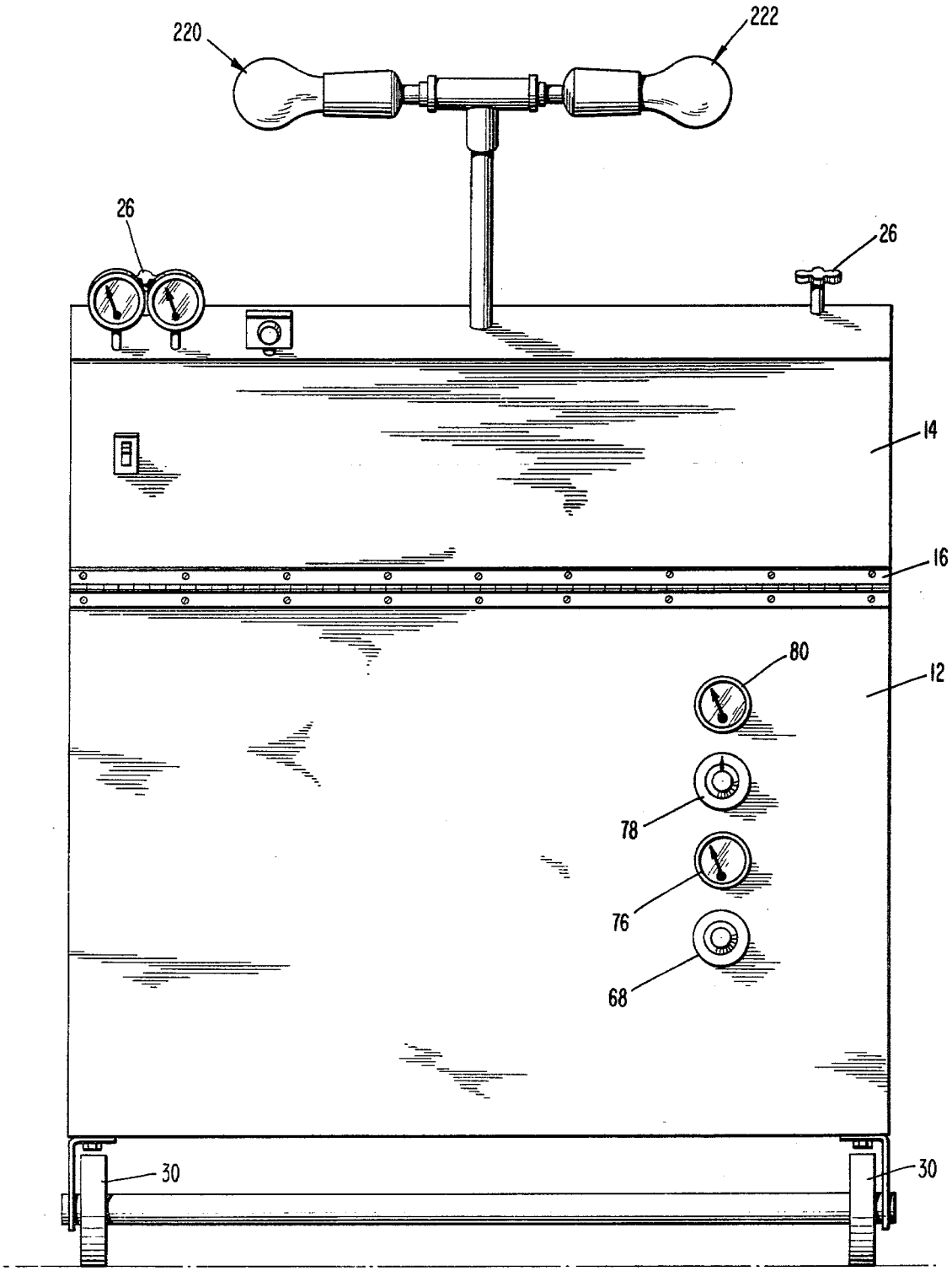
FIG. 5 is a rear view of the exercising apparatus.

A further feature of the invention is the provision of a pair of lights 220, 222 (FIG. 5) which are visible to the user and which are alternately lit to indicate to the user whether the ram is in a forward or reverse mode. For example, a first of the lights 220 may be of a green color and is lit during the forward stroke and the second of the lights 222 may be of a red color and is lit during a reverse stroke. This feature is useful in connection with apoplexy patients with brain damage in that it enables the patient's brain to alert the affected limb as to its position.

In operation, a user's foot or arm is secured to the rod 60 and the reciprocating ram 50 is actuated to reciprocate the latter. Simultaneously, the oscillation motor 90 can be energized to oscillate the rod 60. If desired, either of these motions can be eliminated from the treatment. If the user's arm is to be treated, the bar assembly 130 is utilized and the tensioning devices 150, 152 are adjusted to the desired tension. If necessary, the user's hand can be taped to the hand grip 138.

The exercising device according to the present invention is uncomplicated, easily maneuverable and provides effective treatment. Either the leg or arm of a user can be exercised by reciprocable or oscillatory motion, or a combination of both such motions.

Although the invention has been described in connection with a preferred embodiment thereof, it will be appreciated by those skilled in the art that additions, modifications, substitutions, and deletions not specifically described may be made without departing from the spirit and scope of the invention as defined in the appended claims.

What is claimed is:

1. Apparatus for reciprocating and oscillating a limb of a user comprising:

a housing means;

movable means on said housing means for engaging a limb of a user;

means for connecting said movable means to the limb to prevent relative movement therebetween;

motor means on said housing means for simultaneously reciprocating and oscillating said movable means to reciprocate and oscillate the user's limb;

adjustment means for varying the extent of the stroke of reciprocation and the stroke of oscillation of said movable means;

said movable means comprising a reciprocating rod of a reciprocating motor, said motor means for oscillating said rod including a rotary motor, and means operably interconnecting said rotary motor to said rod to oscillate the rod as the latter is reciprocating; and said reciprocating motor comprising a cylinder, and a double acting fluid actuated piston within said cylinder, said piston being connected to said rod; said interconnecting means comprising a sleeve mounted to said cylinder, a shaft slidably disposed in said sleeve, means connecting an outer end of said shaft to said rod, and a link connecting an output shaft of said rotary motor with said cylinder to oscillate the latter.

2. Apparatus according to claim 1, including a pair of bearings mounted in said housing means, said cylinder being mounted in said bearings.

3. Apparatus according to claim 1, wherein said rotary motor includes an output shaft and a crank member connected to said output shaft, said interconnecting means comprising a link connected at one end to said crank member and at another end to said cylinder, one end of said link being mountable in different locations to increase and decrease the rotary angle of oscillation.

4. Apparatus according to claim 3, wherein said cylinder includes a radially extending flange containing spaced holes defining said spaced locations, said link being selectively connectible to said holes.

5. Apparatus for reciprocating and oscillating a limb of a user comprising:

a housing means, said housing means comprising upper and lower housing sections, said upper housing section being movably connected to said lower housing section to adjust the inclination of the direction of reciprocation;

movable means on said housing means for engaging a limb of a user;

means for connecting said movable means to the limb to prevent relative movement therebetween;

motor means on said housing means for simultaneously reciprocating and oscillating said movable means to reciprocate and oscillate the user's limb; and adjustment means for varying the extent of the stroke of reciprocation and the stroke of oscillation of said movable means.

6. Apparatus for reciprocating and oscillating a limb of a user comprising:

a housing means;

movable means on said housing means for engaging a limb of a user;

means for connecting said movable means to the limb to prevent relative movement therebetween;

bar means attachable to said movable means, a hand grip secured to an outer end of said bar means by securing means for preventing relative rotation between said bar means and said hand grip about the axis of said bar means;

motor means on said housing means for simultaneously reciprocating and oscillating said movable means to reciprocate and oscillate the user's limb; and adjustment means for varying the extent of the stroke of reciprocation and the stroke of oscillation of said movable means.

7. Apparatus according to claim 6 including tensioning means for adjustably tightening said securing means for regulating relative rotational movement between said bar means and said hand grip about a horizontal axis extending perpendicular to the axis of said bar means.

8. Apparatus for reciprocating and oscillating a limb of a user comprising:

a housing means;

movable means on said housing means for engaging a limb of a user;

means for connecting said movable means to the limb to prevent relative movement therebetween;

motor means on said housing means for simultaneously reciprocating and oscillating said movable means to reciprocate and oscillate the user's limb;

adjustment means for varying the extent of the stroke of reciprocation and the stroke of oscillation of said movable means; and two lights visible to the user and being alternately lit to indicate the mode of reciprocal movement.

9. Apparatus for exercising a limb of a user comprising:

a housing including a lower housing section and an upper housing section movably connected to said lower housing section to vary the inclination of said upper housing section;

means for adjusting the inclination of said upper housing section;

a reciprocating rod extending generally horizontally from said upper housing section;

means for connecting an outer end of said rod to a user's limb to prevent relative movement therebetween;

motor means for reciprocating said rod to reciprocate and thereby exercise the user's limb; and adjustment means for varying the extent of the stroke of reciprocation of said rod.

10. Apparatus according to claim 9 including means for oscillating said rod during reciprocation thereof, and additional adjustment means for varying the extent of the stroke of oscillation of said rod.

11. Apparatus according to claim 9, wherein said connecting means comprises a bar assembly including a plurality of pivotably interconnected bar section and a hand grip pivotably mounted at an outer end of an outermost bar section for transmitting reciprocating motions to a user's hands and means for selectively tensioning the pivotable connection of said hand grip.

12. Apparatus for exercising a limb of a user comprising:

a housing including a lower housing section and an upper housing section movably connected to said lower housing section to vary the inclination of said upper housing section;

means for adjusting the inclination of said upper housing section;

an oscillating rod extending generally horizontally from said upper housing section;

means for connecting an outer end of said rod to a user's limb to prevent relative movement therebetween;

motor means for oscillating said rod to oscillate said rod and thereby exercise the user's limb; and adjustment means for varying the extent of the stroke of oscillation of said rod.

13. Apparatus according to claim 12, wherein said connecting means comprises a bar assembly including a plurality of pivotably interconnected bar sections and a hand grip pivotably mounted at an outer end of an outermost bar section for transmitting oscillating motions to a user's and means for selectively tensioning the pivotable connection of said hand grip.

14. Apparatus for exercising a limb of a user comprising:

a housing means;

movable means on said housing means for engaging a limb of a user;

drive means on said housing means for simultaneously reciprocating and oscillating said movable means to exercise the user's limb;

bar means attachable to said movable means, a hand grip secured to an outer end of said bar means by securing means preventing relative rotation between said bar means and said hand grip about the axis of said bar means, and tensioning means for adjustably tightening said securing means for regulating relative movement between said bar means and said hand grip about a horizontal axis extending perpendicular to the axis of said bar means.

15. Apparatus according to claim 14, wherein said bar means comprises first and second bar sections rotationally interconnected by second securing means for relative movement about a horizontal axis extending perpendicular to the axis of said bar means, and second tensioning means for adjustably tightening said second securing means for regulating relative rotational movement therebetween.

16. Apparatus for exercising a limb of a user comprising:

a housing means;

movable means on said housing means for engaging a limb of a user; and drive means on said housing means for simultaneously reciprocating and oscillating said movable means to exercise the user's limb; and two lights visible to the user and being alternately lit to indicate the mode of reciprocal movement.

17. Apparatus for exercising a limb of a user comprising:

a housing including a lower housing section and an upper housing section movably connected to said lower housing section to vary the inclination of said upper housing section;

means for adjusting the inclination of said upper housing section;

a reciprocating rod extending from said upper housing section;

means for connecting an outer end of said rod to a user's limb; and means for reciprocating said rod to reciprocate and thereby exercise the user's foot;

said connecting means comprising a bar assembly including a plurality of pivotably interconnected bar sections and a hand grip pivotably mounted at an outer end of an outermost bar section for transmitting reciprocating motions to a user's hands and means for selectively tensioning the pivotable connection of said hand grip.

18. Apparatus for exercising a limb of a user comprising:

a housing including a lower housing section and an upper housing section movably connected to said lower housing section to vary the inclination of said upper housing section;

means for adjusting the inclination of said upper housing section;

an oscillating rod extending from said upper housing section;

means for connecting an outer end of said rod to a user's limb; and means for oscillating said rod to oscillate and thereby exercise the user's foot;

said connecting means comprising a bar assembly including a plurality of pivotably interconnected bar sections and a hand grip pivotably mounted at an outer end of an outermost bar section for transmitting oscillating motions to a user's hand and means for selectively tensioning the pivotable connection of said hand grip.

* * * * *